United States Patent [19]

Williams

[11] 4,357,966

[45] Nov. 9, 1982

[54] METHOD AND APPARATUS FOR MAKING FLORAL BASKETS

[75] Inventor: Stanley E. Williams, McLeansboro, Ill.

[73] Assignee: George Koch Sons, Inc., Evansville, Ind.

[21] Appl. No.: 259,479

[22] Filed: May 1, 1981

Related U.S. Application Data

[62] Division of Ser. No. 77,126, Sep. 19, 1979.

[51] Int. Cl.[3] ..... B21F 45/00

[52] U.S. Cl. ..... 140/71 R; 140/92.1

[58] Field of Search ..... 140/71 R, 92.1

[56] References Cited

U.S. PATENT DOCUMENTS

| | | | |
|---|---|---|---|
| 739,482 | 9/1903 | Dickinson | 248/153 |
| 857,998 | 6/1907 | Hart | 224/45 W |
| 1,782,886 | 11/1932 | Axell | 47/67 |
| 1,786,062 | 12/1930 | Gruenholz et al. | 47/67 |
| 2,509,566 | 5/1950 | Koch | 248/150 |
| 2,604,288 | 7/1952 | Koch | 224/45 W |

*Primary Examiner*—Howard N. Goldberg
*Assistant Examiner*—K. J. Ramsey
*Attorney, Agent, or Firm*—Jenkins, Coffey, Hyland, Badger & Conard

[57] ABSTRACT

A collapsible frame for supporting a container is manufactured from two loops formed from a single length of wire which are intertwined to form a handle and sprung to form base members which are yieldably urged apart. An inwardly narrowed neck portion is formed intermediate the handle and the base members to provide points of support for the container. A containment loop encompasses the neck portion of the frame and inwardly urges the points of support against the container as it is pushed into position within the containment loop. The base members are capable of being pressed into a planar assembly when the container is removed to allow a plurality of similarly constructed frames to be compactly stacked.

13 Claims, 9 Drawing Figures

METHOD AND APPARATUS FOR MAKING FLORAL BASKETS

This is a division of application Ser. No. 077,126 filed Sept. 19, 1979.

The present invention relates generally to frames for supporting a container such as a floral basket and is more particularly related to a frame which is collapsible to allow a plurality of such frames to be compactly stacked.

One of the most significant problems heretofore associated with florist stands has been the inability to compactly stack the frames for shipping and/or storage. Typically, the frame has been preformed as a rigid structure having no collapsible features for allowing the compact stacking or storage of the frames during periods of non-use. One of the reasons why collapsible frames have not been previously manufactured relates to the inability to economically construct such a frame. These problems and others are solved by the present invention wherein a collapsible frame is provided which may be economically constructed and compactly stacked for shipping and/or storage and is capable of stable support of a florist container.

In accordance with the present invention in its broadest concept, there is provided an apparatus for supporting a container which includes a collapsible frame and means for retaining a container within the frame. The frame includes an expandable base portion and a handle portion constructed such that the retaining means is captured by and encompases the frame intermediate the base portion and the handle portion to lock the apparatus in a supportive position in response to downward pressure applied to the container when positioned within the retaining means.

One feature of the present invention is that the base portion, handle portion, and an inwardly narrowed intermediate portion of the frame are formed from a single length of wire including two loops. The loops are intertwined to form a rigid handle portion and are sprung to form base members which are yieldably urged apart in spaced relation to each other and equally angled from the plane within which the handle lies to provide support for the frame.

Another feature of the present invention is that the reduced intermediate portion provides four points of support for the container when the container is positioned in the frame. The retaining means is forcibly expandable for spring action to inwardly urge the points of support against the container in response to downward pressure applied to the container such that an increase in downward pressure on the container causes a corresponding increase in pressure by the points of support against the container. Furthermore, the retaining means determines the maximum spacing between the base members by having a periphery which is generally equivalent to the reduced intermediate portion of the frame when the base members are urged apart.

The base members of the apparatus described hereinabove are capable of being pressed into a planar assembly when the container is removed from the frame to allow a plurality of similarly constructed frames to be compactly stacked.

In making the collapsible florist stand, two generally rounded loops are formed from a single wire generally in a single plane. The wire at the end of one loop is wrapped about the wire of the other loop to form a handle by retaining a portion of the two loops together. The wire loops are positioned about a generally rounded mandrel and two stationary posts located and spaced from an axis that bisects the generally rounded mandrel. The handle portion of the loops is adjacent the mandrel. The two loops are bent adjacent the handle portion generally against the rounded mandrel by forcing the wire loops inwardly against the mandrel at two points located between the mandrel and the stationary posts, and the two loops are further bent generally in the direction of the mandrel at a point between the two stationary posts to form a four point base. The two wire loops are further bent apart from the generally single plane adjacent the stationary posts and outside of the handle portion.

Other features and advantages of the present invention will be apparent from the following detailed description of an embodiment hereof, which description should be considered in conjunction with the accompanying drawings in which.

Figure 2:
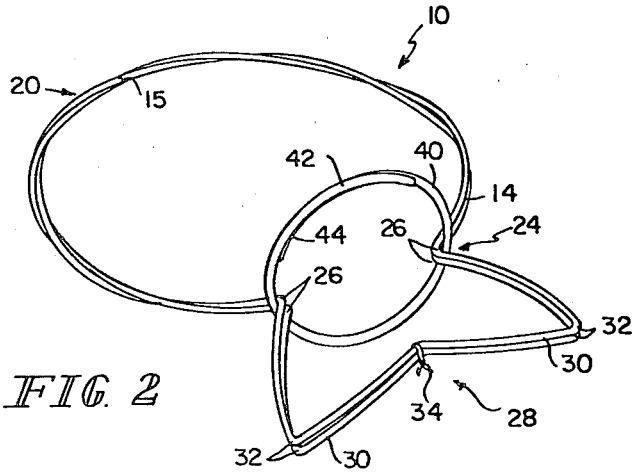
FIG. 2 is another perspective view of the apparatus shown in FIG. 1 illustrated in a collapsed position.

Illustrated in FIGS. 1–6 are various views of a collapsible apparatus or frame 10 such as might be used by a florist to support a floral arrangement in a container 12. In general, an advantage associated with the apparatus 10 of the present invention is the fact that it may be collapsed and thereby become substantially planar to allow two or more similarly constructed apparatus 10 to be stacked for storage or shipping, as best illustrated in FIG. 2.

Figure 5:
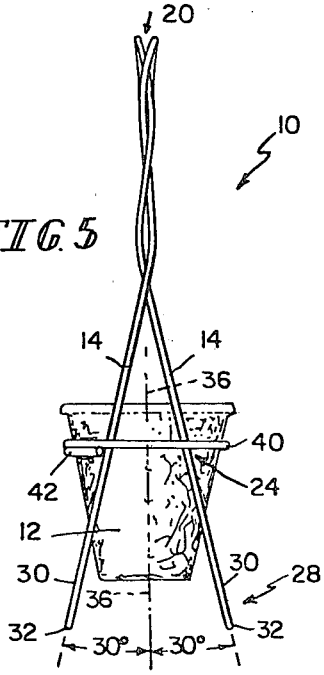
FIG. 5 is a side elevational view of the apparatus shown in FIG. 4.
Figure 6:
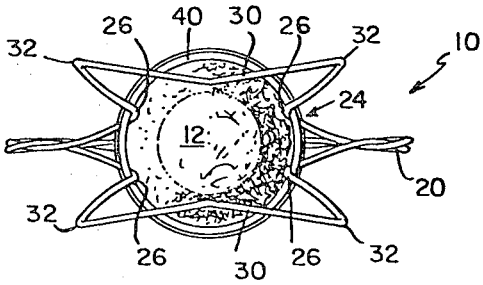
FIG. 6 is a bottom elevational view of the apparatus shown in FIGS. 4 and 5.
Figure 3:
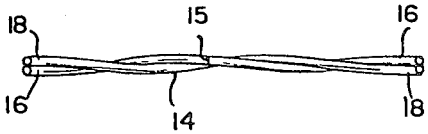
FIG. 3 is a cross-sectional view of the apparatus shown in FIG. 1 taken generally along section lines 3—3 in FIG. 1.

The frame 10 includes a first wire 14 of sufficient length to form a first loop 16 and a second loop 18 superposed and lying generally in a single plane as best illustrated in FIG. 3. The first wire 14 may comprise any size wire of sufficient rigidity to withstand the loads associated with the apparatus; however, #7 gauge wire has generally been found to be adequate. The two loose ends 15 of the first wire 14 are included within the second loop 18 and intertwined about the first loop 16 to form an upwardly extending handle portion 20 of the frame 10. An intermediate portion 24 is inwardly narrowed to form four container supports 26 and a base portion 28. The first and second loops 16, 18 are sprung to form two base members 30 which are yieldably urged apart to support the frame 10. To increase the stability of the frame 10, each base member 30 is further subdivided to provide four supportive feet 32. As illustrated in FIG. 2, the base members 30 are capable of being pressed together into a planar assembly when a container 12 is not being supported by the frame 10 to allow a plurality of similarly constructed frames 10 to be compactly stacked. Because the two loops 16, 18 have been sprung, the base members 30 have a natural tendency to be urged apart; accordingly, when the base members 30 are pressed into a planar assembly, it may be necessary that they be maintained together by a tie 34. It should be understood that once the tie 34 is removed, the base members 30 will be yieldably urged apart to provide the supportive feet 32 for the frame 10. As illustrated in FIG. 5, the two wire loops 16, 18 are sprung apart such that the base members 30 are each formed at an angle of 30° from the plane 36 within which the handle portion 20 lies. Importantly, therefore, the total angle between the base members 30 is 60°.

Figure 1:
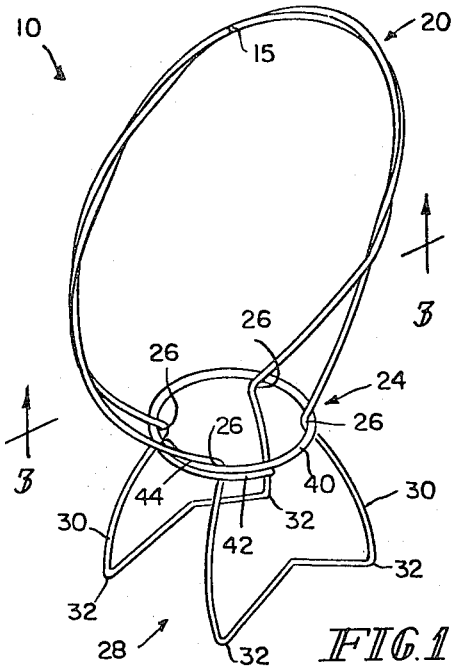
FIG. 1 is a perspective view of an apparatus constructed in accordance with the present invention.
Figure 4:
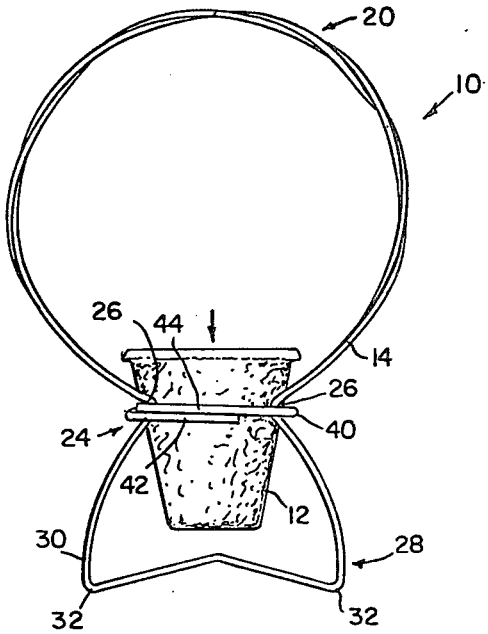
FIG. 4 is a front or back elevational view of the apparatus shown in FIG. 1 illustrating the support of a container.

A second wire 40 is formed into a third loop having its loose ends 42, 44 overlapped such that the wire 40 may be forcibly expanded for spring action. In the illustrative embodiment, the loose ends 42, 44 overlap four inches and the wire 40 has a diameter of eight and one-half inches. Furthermore, #5 gauge wire has been found sufficient to form the third loop. The second wire 40 encompasses the narrowed intermediate portion 24 of the frame 10 and serves as a containment loop to maintain the points of support 26 of the intermediate portion 24 against the container 12 as it is pushed into position within the frame 10. In effect, the second wire 40 serves as a means for retaining the container 12 within the frame 10 in response to pressure being applied downwardly against the container 12 in the general direction of the arrow shown in FIG. 4. In response to the downward force applied to container 12, the four container supports 26 of the intermediate portion 24 may be forcibly urged against the container 12 by the spring action of the second wire 40 to thereby lock the frame 10 in a supportive position as best illustrated in FIGS. 4 and 5. As will be understood, an increase in the downward pressure applied to container 12 causes a corresponding increase in the pressure by the points of support 26 against the sides of the container 12 due to the spring action of second wire 40. Furthermore, the spring action of the second wire 40 provides a means for determining the maximum spacing between the base members 30. In its unexpanded position, the second wire 40 has a circumference or periphery which is generally equivalent to the periphery of a loop encompassing the reduced intermediate portion 24 of the frame 10 when the base members 30 are yieldably urged apart in the absence of the container 12.

Figure 7:
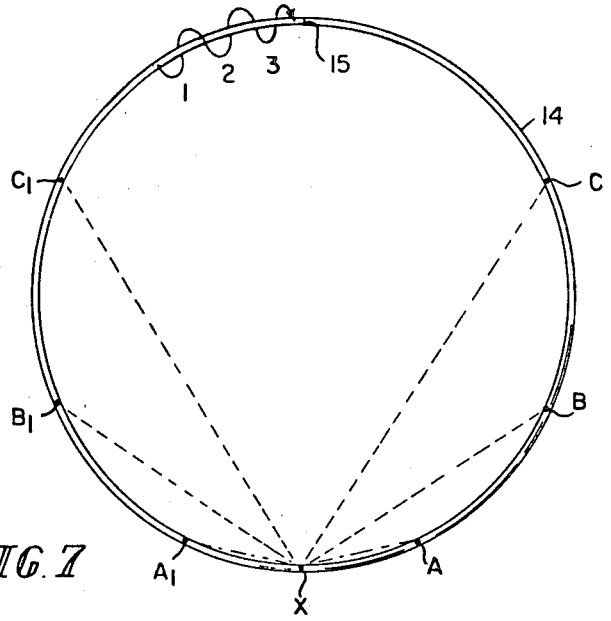
FIG. 7 is an elevational view of the wire loops used to form the apparatus shown in FIGS. 1–6 illustrating a stage in the formation of the apparatus.

Referring now to FIG. 7, the first wire 14 is shown prior to its formation into the frame 10 described hereinabove. Generally, the two wire loops 16, 18 formed from the first wire 12 are initially circular in shape and have a predetermined diameter, which in the illustrative embodiment is thirty inches. As best illustrated in FIGS. 3 and 7, the loose ends of the second loop 18 are intertwined three turns about the first loop 16 and butt welded at a point 15 to form the handle portion 20 of the frame 10. This represents the first stage of the formation of frame 10. Symmetrically located on the circumference of the loops 16, 18 are six points A, B, C and $A_1$, $B_1$, $C_1$ for forming the handle portion 20, the intermediate portion 24, and the base portion 28 of the frame 10. A point X also located on the circumference of the loops 16, 18 serves as a reference point for symmetrically positioning the forming points on the periphery of the loops 16, 18. Forming points A, $A_1$ are located on the circumference of the loops 16, 18 on either side of reference point X at a distance of six and one-half inches measured in a straight line from point X to the circumference of the loops 16, 18. As will be described in more detail hereinafter, forming points A, $A_1$ will remain fixed on the circumference of the loops 16, 18 during the forming process of frame 10. Forming points B, $B_1$ are located on the circumference of the loops 16, 18 on either side of reference point X at a distance of sixteen and one-fourth inches measured on a straight line from point X to the circumference of the loops 16, 18. A third set of forming points C, $C_1$ are located on the circumference of the loops 16, 18 on either side of reference point X at a distance of twenty-five inches measured on a straight line from point X to the circumference of loops 16, 18.

Figure 9:
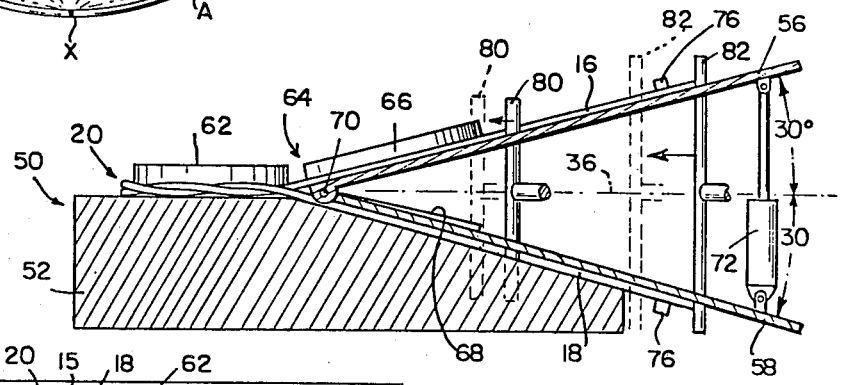
FIG. 9 is a cross-sectional view of the forming mechanism shown in FIG. 8 taken generally along section lines 9—9 in FIG. 8.
Figure 8:
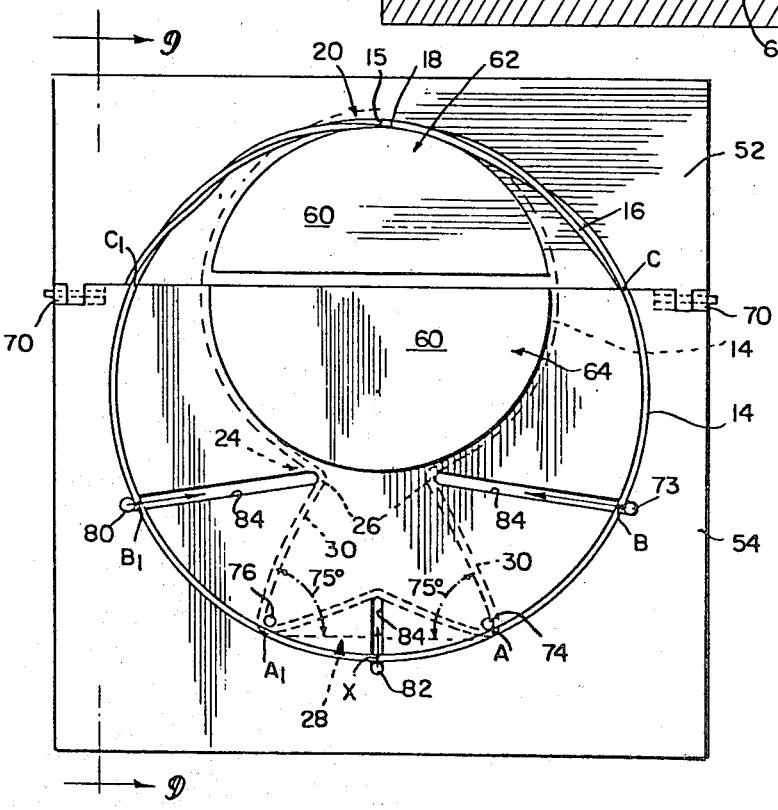
FIG. 8 is an elevational view of an embodiment of a mechanism used for forming the apparatus shown in FIGS. 1–6.

As best illustrated in FIGS. 8 and 9, the frame 10 is formed from the first wire 14 shown in FIG. 7 by employing a forming mechanism 50. It should be understood that while FIGS. 8 and 9 show an embodiment of a mechanism 50 which may be employed in the formation of the frame 10 from the first wire 14, other mechanisms may be employed for accomplishing the formation of the frame 10 without departing from the spirit of the present invention. As indicated in FIGS. 8 and 9, loops 16, 18 will have been intertwined to form the handle portion 20 of frame 10 prior to employment of the forming mechanism 50. In the illustrative embodiment, forming mechanism 50 includes a stationary portion 52 and a bifurcated portion 54 which may be separated as illustrated in FIG. 9 into an upper half 56 and a lower half 58. A mandrel 60 is provided on the portions 52 and 54 such that a first half 62 of the mandrel 60 is situated on the stationary portion 52 of forming mechanism 50 and a second half 64 of mandrel 60 is situated on the bifurcated portion 54 of the forming mechanism 50. As illustrated in FIG. 9, the second half 64 of mandrel 60 is bifurcated and includes an upper half 66 and a lower half 68 which are separable in conjunction with the separation of the bifurcated portion 54 of forming mechanism 50. The two halves 56, 58 of bifurcated portion 54 are pivotally connected at one end by conventional hinges 70, and a hydraulic mechanism 72 may be employed at the opposite end to separate the two halves 56, 58 in the manner illustrated in FIG. 9. The mandrel 60 is generally circular and has a diameter which is less than the diameter of the two loops 16, 18 formed from first wire 14. Initially, the two loops 16, 18 will be contained on the forming mechanism 50 by the mandrel 60 and two limit posts 74, 76 engaging the inside of loops 16, 18. Importantly, the two loops 16, 18 will be positioned on the forming mechanism 50 such that the limit posts 74, 76 correspond to the forming points A, $A_1$ on the circumference of the loops 16, 18. Accordingly, as the frame 10 is formed, the limit posts 16, 18 serve to maintain the forming points A, $A_1$ on the original diameter of the loops 16, 18. It should also be noted that the loops 16, 18 are positioned on the forming mechanism 50 such that the forming points C, $C_1$ coincide with the hinges 70 for pivotally separating the halves 56, 58 of bifurcated portion 54.

The forming mechanism 50 further includes three upstanding forming posts 78, 80, and 82 which are generally slidable inwardly in the direction of the arrows shown in FIGS. 8 and 9 along guides 84 provided in both the upper and lower halves 56, 58 of the bifurcated portion 54 of mechanism 50. It is important that the guides 84 be of sufficient length that the forming posts 78, 80, and 82 are located outside of the circumference of the loops 16, 18 when the loops 16, 18 are initially positioned on the mechanism 50.

In forming the frame 10, forming posts 78 and 80 corresponding to forming points B, $B_1$ are moved inwardly toward each other such that the circumference of the loops 16, 18 is drawn inwardly toward each other at forming points B, $B_1$ to form the generally elliptical shaped handle portion 20 about the mandrel 60, the intermediate portion 24, and the base portion 28. The forming posts 78 and 80 are moved inwardly toward each other a sufficient distance from the original circumference of the loops 16, 18 to form an angle of approximately 75° measured from an imaginary line connecting forming points A, $A_1$ to the portions of the loop 16, 18 forming the base portion 28. Just as the mandrel 60 maintains the handle portion 20 of the frame 10 in position during the movement of forming posts 78 and 80, the limit posts 74 and 76 also maintain the original circumference of the loops 16, 18 at forming points A, $A_1$. Either subsequently or coincidental with the sliding movement of forming posts 78 and 80, the forming post 82 is also moved inwardly to draw the loops 16, 18 inward at the reference point X such that the bottom of such portion 30 is subdivided to form the supportive feet 32 of frame 10. Therefore, it can be seen that in one step the elliptical handle portion 20, the intermediate portion 24, and the base portion 28 of the frame 10 may be formed.

In another step of the forming process, the upper and lower halves 56 and 58 of the bifurcated portion 54 of forming mechanism 50 are pivotally separated by hydraulic mechanism 72 so that each subtends an angle of approximately 30° from the plane 36 within which the handle portion 20 lies. This separation of the upper and lower halves 56 and 58 of the bifurcated portion 54 springs the two loops 16, 18 to yieldably urge the loops 16, 18 apart at forming points C, $C_1$ and thereby form the base members 30.

As will be apparent from FIG. 9, before the halves 56 and 58 are pivotally separated the bifurcated portion 54 of the mechanism 50 must be positioned between the loops 16 and 18 so that in the process of separation loop 16 is sprung upwardly by upper half 56 and loop 18 is sprung downwardly by lower half 58 and the lower and upper halves 66, 68 of mandrel 100 correspondingly form the handle portion 20 from the loops 16 and 18, respectively. It should be understood that while it has been found advantageous to separate the bifurcated portion 54 of the mechanism 50 first and then slide the forming posts 78, 80, and 82 to form the handle portion 20, the narrowed intermediate portion 24, and the base portion 28, the sequence of these steps may be reversed in the forming process. In the illustrative embodient of forming mechanism 50, it can therefore be seen that the frame 10 of the present invention may be economically constructed in a series of three steps.

What is claimed is:

1. In a method of making a collapsible florist stand, the steps comprising forming two generally rounded loops from a single wire generally in a single plane, the wire at the end of one loop being wrapped about the wire of the other loop to form a handle by retaining a portion of the two loops together, positioning the wire loops about a generally rounded mandrel and two spaced posts located outside and spaced from the rounded mandrel with the handle portion adjacent the mandrel, bending the two loops adjacent the handle portion generally against the rounded mandrel by forcing the wire loops inwardly against the mandrel at two points between the mandrel and the spaced posts to complete formation of the handle portion, and bending the two loops generally in the direction of the mandrel at a point between the two spaced posts to form four support points, and bending the portion of the two wire loops adjacent the spaced posts and outside of the handle portion apart to form a four point base.

2. Apparatus for the manufacture of a collapsible florist stand from two wire loops comprising a stationary portion and a bifurcated portion including juxtaposed members capable of pivoted movement into two positions at an acute angular relationship with respect to one another, the bifurcated portion being capable of holding and bending one loop to one position and the other wire loop to the other position, a mandrel with a generally rounded portion on the apparatus, two stationary posts located at the bifurcated portion spaced equally from an axis that bisects the generally rounded mandrel, two wire bending posts that are located in the bifurcated portion between the generally rounded mandrel and the stationary posts and that extend through slots in the bifurcated portion and are drivable in the direction of the rounded mandrel and a third wire bending post that is located between the two stationary posts and that extends though a slot in the bifurcated portion and is drivable in the direction of the rounded mandrel, first manipulation means to drive the three wire bending posts in the direction of the rounded mandrel and second means to move the bifurcated portion of the apparatus into an angular relationship, whereby two wire loops, positioned on the apparatus about the rounded mandrel and the stationary loops and within the three wire bending posts, are bent into a collapsible florist stand with a rounded handle portion and four container support points, by operation of the first means and the two loops are sprung apart to form a four point base by operation of the second means.

3. The method of claim 1 wherein forming points on the circumference of the wire loops are symmetrically positioned about the rounded mandrel and the two spaced posts.

4. The method of claim 3 wherein the two loops are bent inwardly against the rounded mandrel at first forming points to form a generally elliptical shaped handle portion, a narrow intermediate portion and a base portion.

5. The method of claim 4 wherein the based portion is formed by positioning the inside circumference of the wire loops against the two spaced posts and maintaining second forming points on the circumference of the wire loops while the loops are bent inward at the first forming points.

6. The method of claim 5 wherein the two loops are bent inwardly at the first forming points and at the point between the two spaced posts by positioning three forming posts outside the circumference of the loops and moving the forming posts inwardly into engagement with the wire loops at such points.

7. The method of claim 6 wherein the two loops are bent apart at third forming points so that each loop subtends generally the same angle from the plane of the handle portion.

8. The method of claim 7 further comprising the steps of springing one of the loops upwardly at the third forming points and springing the other loop downwardly at the third forming points to thereby yieldably urge the loops apart at such forming points.

9. The apparatus of claim 2 wherein the bifurcated portion includes an upper half for springing one wire loop upwardly and a lower half for springing the other wire loop downwardly so that each wire loop subtends generally the same angle from the plane of the handle portion.

10. The apparatus of claim 9 wherein the mandrel includes a first half provided on the stationary portion and a second half provided on the bifurcated portion.

11. The apparatus of claim 10 wherein the second half of the mandrel is bifurcated and includes an upper half provided on the upper half of the bifurcated portion of the apparatus and a lower half provided on the lower half of the bifurcated portion of the apparatus.

12. The apparatus of claim 11 further comprising pivot means connected between the upper and lower halves of the bifurcated portion for allowing movement of the halves into an angular relationship.

13. The apparatus of claim 12 wherein two stationary posts are located on each of the upper and lower halves of the bifurcated portion and slots for the three wire bending posts are provided in each of the upper and lower halves of the bifurcated portion.

* * * * *